US006978848B2

(12) United States Patent
Nackerud

(10) Patent No.: US 6,978,848 B2
(45) Date of Patent: Dec. 27, 2005

(54) METHOD AND APPARATUS FOR PENETRATING SUBSURFACE FORMATIONS

(76) Inventor: Alan L. Nackerud, 6801 N. Peterson Rd., Sedalia, CO (US) 80135

( * ) Notice: Subject to any disclaimer, the term of this patent is extended or adjusted under 35 U.S.C. 154(b) by 0 days.

(21) Appl. No.: 10/428,499

(22) Filed: May 2, 2003

(65) Prior Publication Data

US 2004/0216592 A1 Nov. 4, 2004

(51) Int. Cl.[7] ..... E21B 43/118

(52) U.S. Cl. ..... 175/4.53; 175/4.57; 89/1.15; 102/321

(58) Field of Search ..... 89/1.15; 175/4.53, 175/4.55, 4.57, 4.59; 102/312, 313, 321; 166/63

(56) References Cited

U.S. PATENT DOCUMENTS 1,582,184 A * 4/1926 Mims ..... 175/4.57
2,210,192 A * 8/1940 Turechek ..... 175/4.59
2,281,870 A * 5/1942 Cole ..... 175/4.58
2,639,770 A * 5/1953 Huber ..... 175/4.53
2,644,519 A * 7/1953 Kanady ..... 175/4.53
2,664,157 A * 12/1953 Abendroth ..... 175/4.53
2,664,158 A * 12/1953 McKean ..... 175/4.53
2,695,665 A * 11/1954 Box et al. ..... 175/4.58
2,947,253 A * 8/1960 Cirilo ..... 175/4.53
3,072,054 A * 1/1963 Ashbrook ..... 175/3.5

* cited by examiner

*Primary Examiner*—Stephen M. Johnson
(74) *Attorney, Agent, or Firm*—John E. Reilly; Ellen Reilly

(57) ABSTRACT

A method and apparatus for driving at least one explosive driven projectile into an open hole or well bore of a subterranean formation for the purpose of stimulating productive formation. The apparatus is capable of pivoting within the open hole or well bore for desired firing at an angle and is also capable of deep penetration into a subterranean formation. The apparatus may also be conveyed by a tubing in horizontal drilling applications.

13 Claims, 12 Drawing Sheets

METHOD AND APPARATUS FOR PENETRATING SUBSURFACE FORMATIONS

BACKGROUND AND FIELD OF INVENTION

This invention relates to a method and apparatus for penetrating an existing subterranean formation; and more particularly relates to a method and apparatus for driving a projectile through an existing subterranean formation for enhanced production of coal, petroleum or other solid, gas or liquid substances.

In the recovery of petroleum, gas or liquid substances from subterranean formations, a well bore is formed into the earth and an open hole or cavity is formed beyond the well bore. Once the subterranean formation has been drilled by conventional methods, it is often necessary to stimulate or enhance production. Typically in the past, fluid has been pumped under pressure into the well and into the formation to induce hydraulic fracturing of the formation or by acidizing the well formation with chemical substances to treat or stimulate the formation. Conventional open hole and cased hole completions in combination with fracturing or chemical treatments have severe limitations. These treatments may actually cause the formations to seal up. Further, mediums of low permeability and low porosity are much more difficult to open up with these treatments. Finally, methods involving horizontal drilling applications are extremely difficult, often unsuccessful and can be prohibitively expensive.

There is an unmet need for a method and apparatus for rejuvenating or stimulating an open hole or cavern well in such a way as to substantially increase production rates and overcome the numerous problems and drawbacks inherent in the conventional methods. In particular, it is proposed to employ a novel projectile apparatus which is capable of penetrating a subterranean formation as well as orienting and rotating the projectile within the open hole for discharging the projectile member into the formation.

SUMMARY OF THE INVENTION

It is therefore an object of the present invention to provide for a novel and improved well stimulation method and apparatus which is capable of driving projectiles into a subterranean formation without formation damage caused by chemical alteration or without residual particles in the well bore.

It is another object of the present invention to provide for a novel and improved well stimulation method and apparatus which does not require costly extraction of treatment materials from the open hole and also provides for reusable equipment.

It is a further object of the present invention to provide for a novel and improved method and apparatus for subterranean formation stimulation having rotational means for orienting the equipment.

It is a further object of the present invention to provide for a novel and improved method and apparatus for subterranean formation stimulation which is conformable for use in vertical as well as in horizontal or directional drilling.

It is still a further object of the present invention to provide for a well stimulation method and apparatus which is easy to install, inexpensive, compact and highly efficient and reliable in use.

In accordance with the present invention, an apparatus has been devised for use in penetrating a cavern at a lower end of a well bore in a subsurface formation wherein the diameter of the cavern is greater than that of the well bore, the apparatus comprising means for penetrating the cavern, the means including an elongated projectile assembly having a projectile member disposed in the assembly and an explosive charge behind the projectile member, the projectile member being of a lenath greater than the diameter of the well bore but less than the diameter of the cavern, a suspension member including means for advancing the suspension members through the well bore, the projectile assembly pivotally mounted externally of the suspension member for extension alongside the suspension member, means for pivoting the projectile assembly between a first position extending substantially parallel to a longitudinal axis or the well bore and the second position substantially perpendicular to the longitudinal axis of the well bore, and means for detonating the explosive charge whereby to discharge the projectile member into a wall of the cavern.

A method in accordance with the present invention comprises the steps of discharging an elongated projectile into a subterranean formation comprises the steps of mounting the projectile in a tube, positioning an explosive charge behind the projectile within the tube, advancing the tube containing the projectile and explosive charge through a well bore and into an enlarged cavity at the end of the well bore, orienting the tube at a selected firing angle within the cavity, and detonating the explosive charge to discharge the projectile from the tube into the formation.

There has been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

The following is a description of an apparatus for penetrating a cavern or open hole H at a lower end of a well bore B in a subsurface formation where the diameter of the cavern or open hole H is greater than that of the well bore B.

Figure 1:
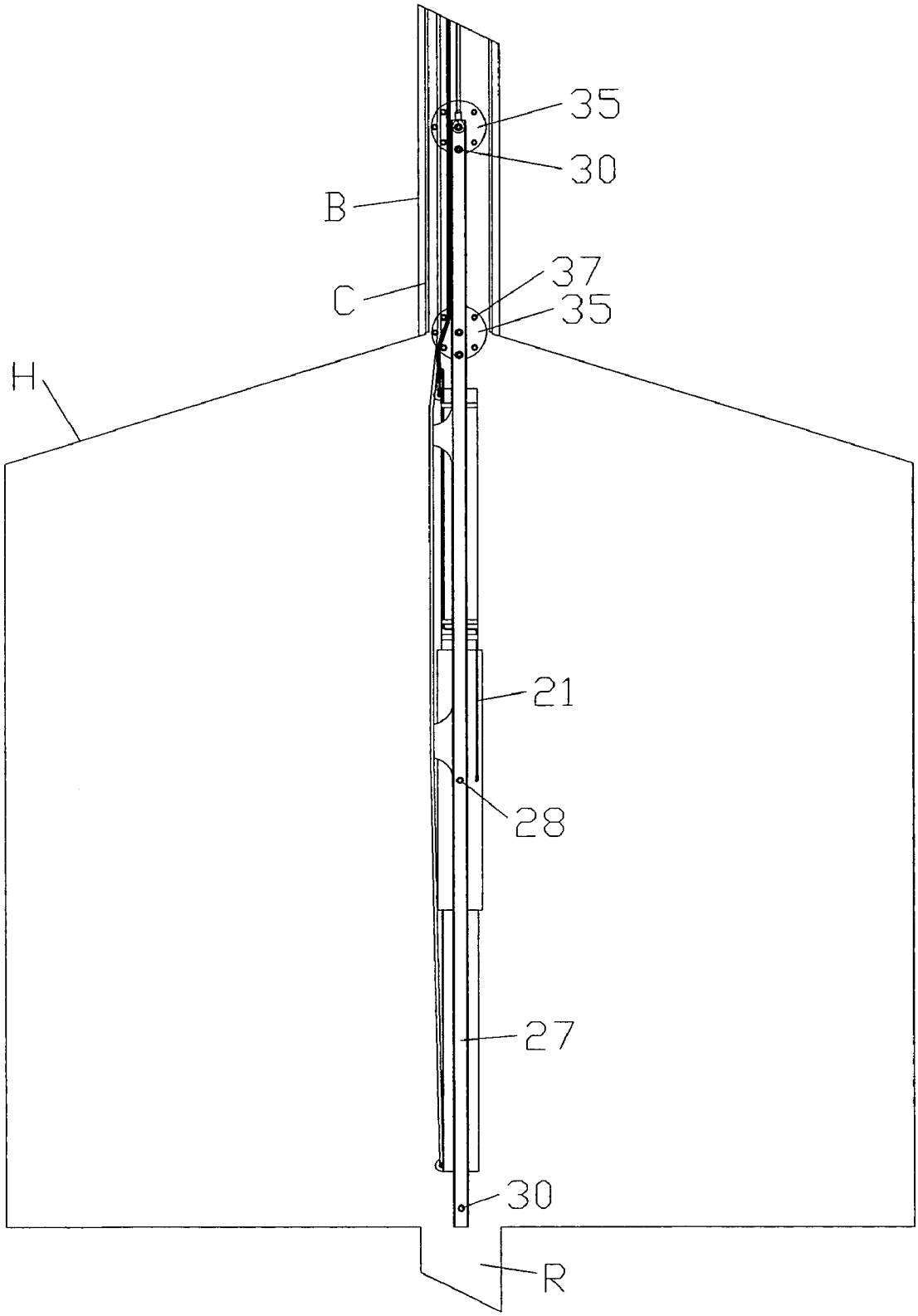
FIG. 1 is a side view in elevation of one preferred form of tool suspended from a wire line.
Figure 2:
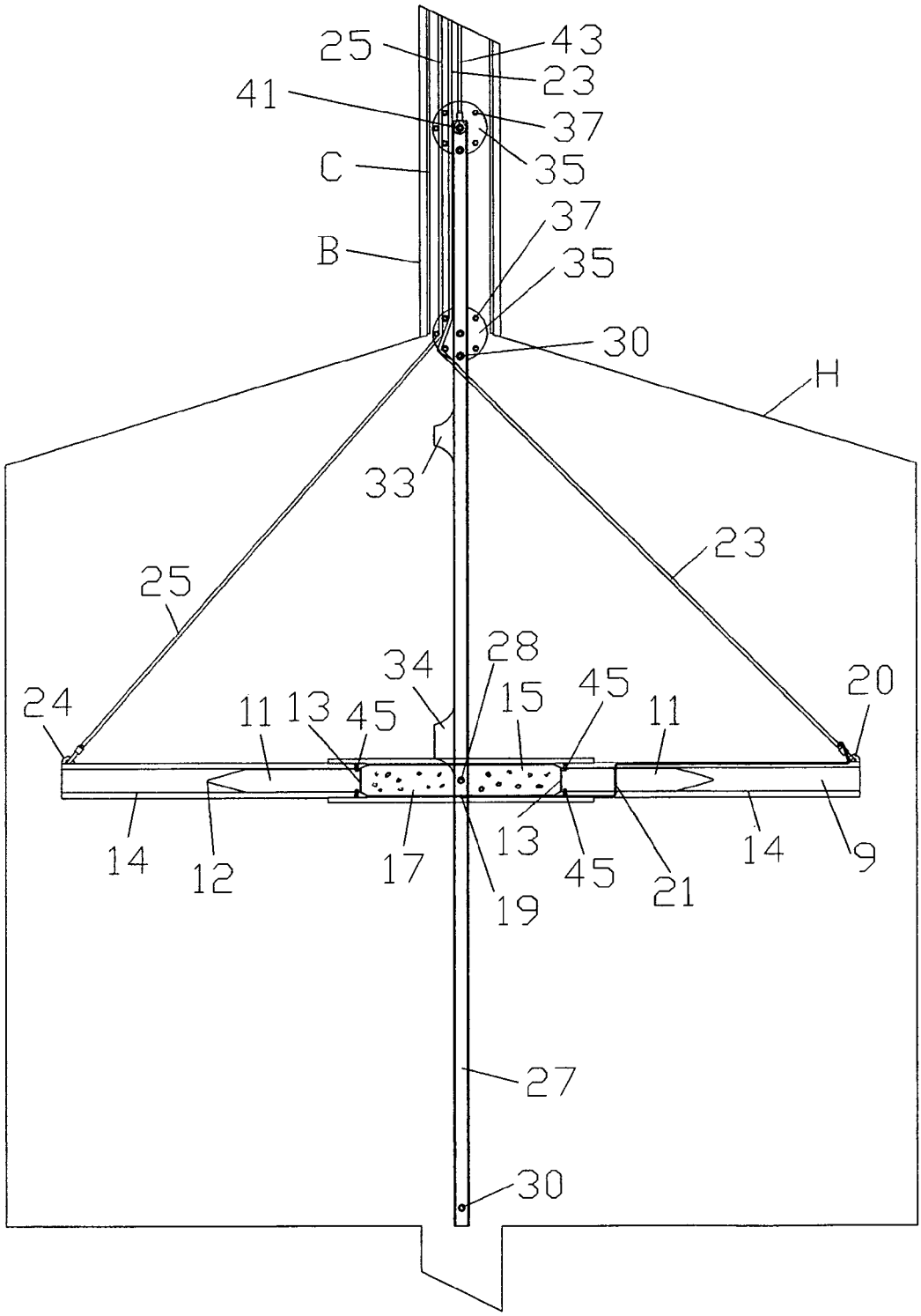
FIG. 2 is another side view in elevation of the form of invention shown in FIG. 1 with the tool being deployed into its firing position.
Figure 3:
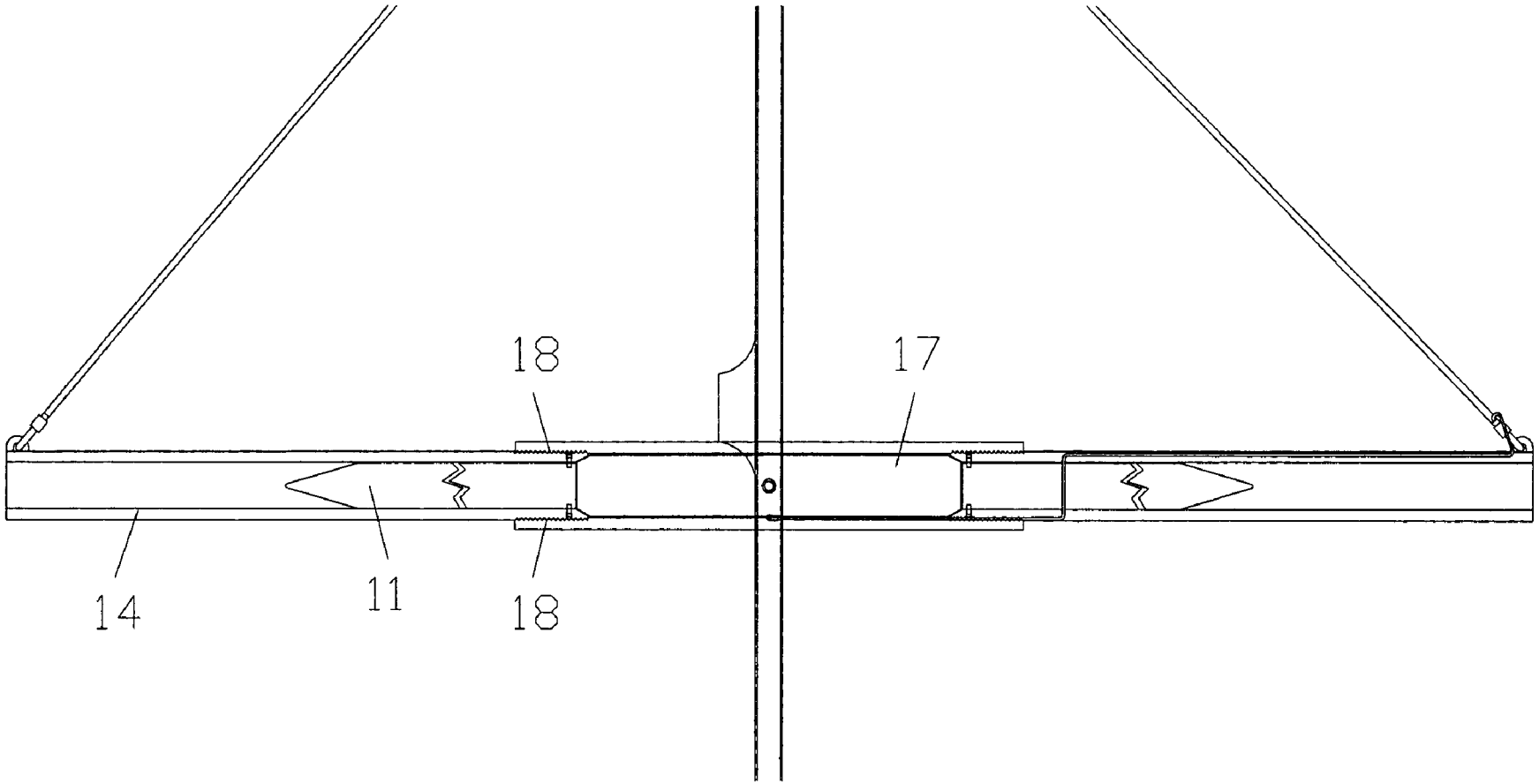
FIG. 3 is an enlarged side view of the tool shown in FIGS. 1 and 2 in its deployed state.

Referring in more detail to FIGS. 1 to 6, there is illustrated one form of tool or apparatus 9 having a pair of elongated projectile members 11 which are each in the form of a bullet or solid elongated body having a pointed end 12 and an opposite, squared rear end 13, the body being preferably formed of a high density metal, such as for example, steel. The projectile members 11 are releasably fixed within projectile tubes 14 with a set of shear pins 45 and set screws (not shown) The projectile tubes 14 have their rear ends 13 in opposed confronting relation to one another but separated by an explosive charge 15 between the projectile members 11. The explosive charge 15 is contained within an explosive tube 17 and is sealed to prevent water from entering the explosive tube 17. The explosive tube 17 is threadedly connected to the projectile tubes 14 forming a projectile assembly as shown in FIG. 3 at 18. Alternatively, a single continuous length tube containing the explosive charge 15 and the projectile members 11 may be used. The explosive tube 17 has a hole, not shown, at the center point of the explosive tube 17 where an igniter 19 makes contact with the explosive charge 15. The igniter 19 is also sealed to be watertight and connected to an igniter wire 21 which runs from the igniter 19 and extend along a side of the explosive tube 17 and along the side of one of the projectile tubes 14.

The explosive tube 17 is mounted externally to complementary elongated suspension members or carrier plates 27, located on opposite sides of the explosive tube 17, by a center pivot pin 28 as well as suitable fasteners 30 at the bottom and top of the carrier plates. The carrier, plates 27 are also welded together by semi-circular tube stops 33 and 34, the lower tube stop 34 being located just above the center pivot pin 28 and the upper tube stop 33 located near the top portion of the carrier plates 27. The top portions of the carrier plates 27 also have one or more circular interior guide plates 35, a pair of the plates 35 being illustrated in vertically spaced relation to one another in FIGS. 1 and 2. The tube stops 33 and 34 permit pivoting or rotation of the explosive tube 17 and projectile tubes 14 from a position extending substantially parallel to the carrier plates 27 and the well bore B to a position substantially perpendicular to the carrier plates and the well bore B, and not beyond, in a general shooting position; and the upper tube stop 33 allows the tubes 17 and 14 to return to a position parallel to the carrier plates, but not beyond, for extraction or removal from the cavern or open hole H.

The explosive tube 17 which is threadedly attached to the projectile tubes 14 has a first rotator wire line 23 attached which aids in advancing the plates 27 through the well bore and pivoting the explosive tube 17 and the projectile tubes 14 within the cavern to a bolt 20 on an upper portion of the projectile tube 14. The first rotator wire line 23 is then passed around or between guide bolts 37 which are spaced around the peripheries of the circular interior plates 35, the latter being bolted to the carrier plates 27, and the plates 27 assist in centralizing the apparatus 9 in the open hole H and directing the apparatus 9 back through the casing C for removal.

A second rotator wire line 25 is connected to a bolt 24 on an upper portion of the projectile tube 14. The second rotator wire line 25 is woven through the guide bolts 37 of the interior plates 35. The guide bolts 37 assist in keeping the first and second rotator wire lines 23 and 25 in proper position and prevent entanglement.

Figure 4:
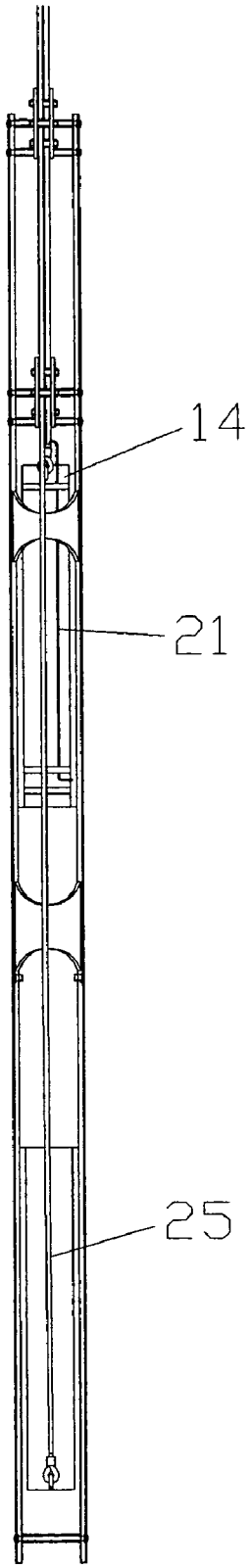
FIG. 4 is a top plan view of the form of invention shown in FIG. 1.

The first rotator wire line 23 and the second rotator wire line 25 are connected through a top bolt 41 on the carrier 35 to a main wire line 43 for delivery and removal of the apparatus 9 to and from the open hole H. As can be seen in FIG. 4, the first and second rotator wire lines 23 and 25 remain outside the apparatus 9 and the igniter wire 21 runs along the outer surface of the projectile tube 16. The lower tube stop 34 allows rotation of the apparatus 9 to a position perpendicular to the carrier plates 27, as shown in FIGS. 2 and 3 and not beyond, in a general shooting position. The upper tube stop 33 allows the apparatus 9 to move back to a position parallel to the carrier plates 27, as shown in FIG. 1, but not beyond, for extraction from the open hole.

Figure 5:
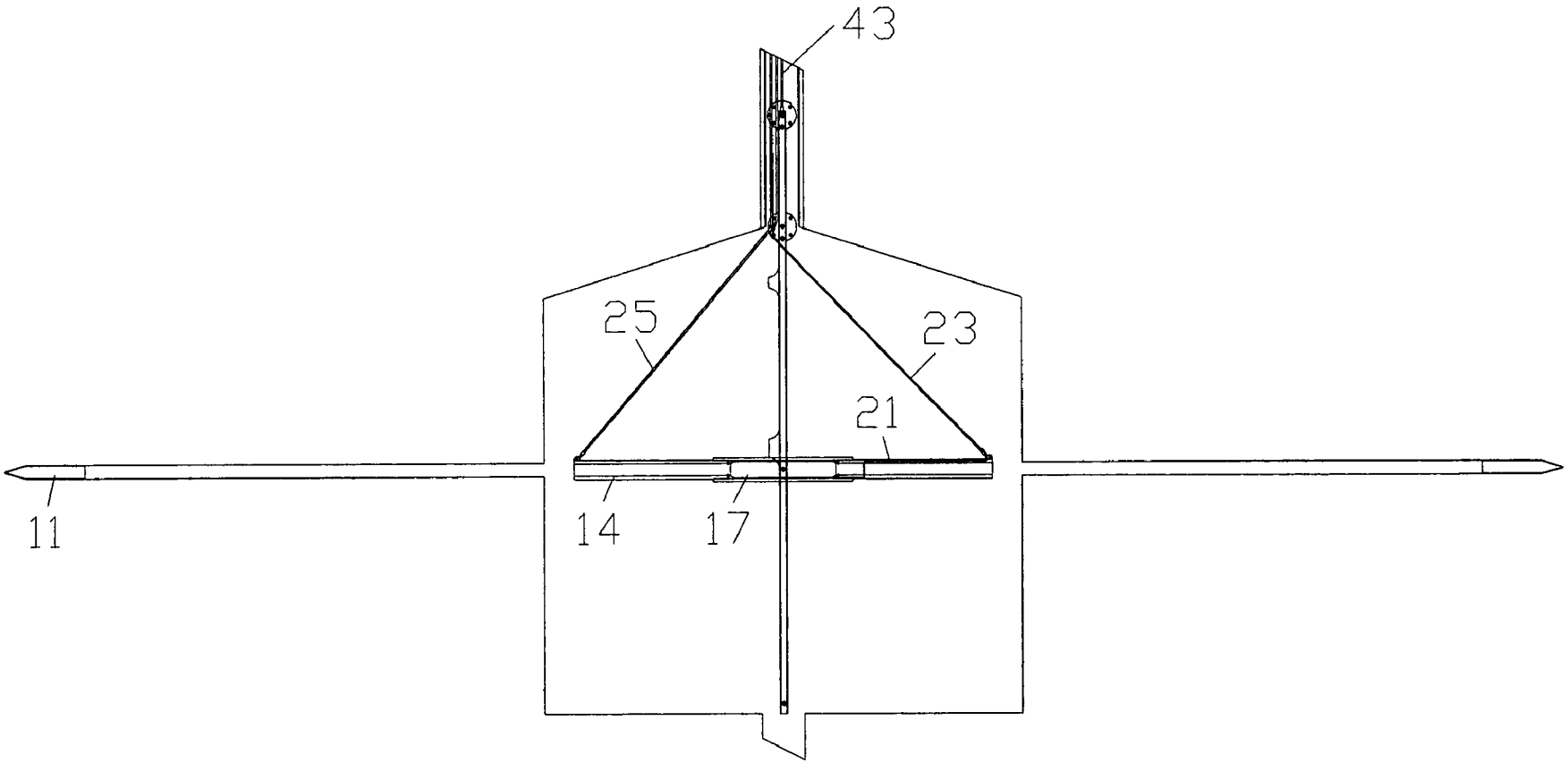
FIG. 5 is a somewhat schematic side view of the form of invention shown in FIG. 1 in its firing position.
Figure 6A:
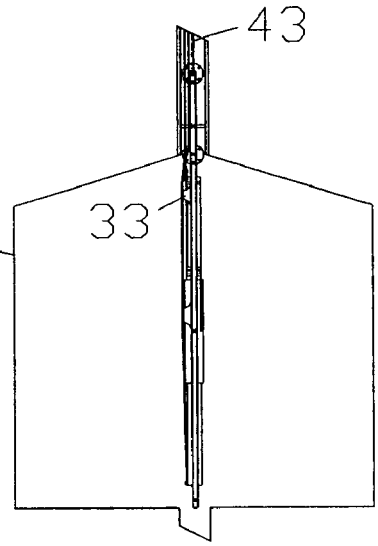
FIG. 6 is a schematic view of the form of invention shown in FIG. 1 in its suspended, deployed and firing position.

In the method of invention as shown in FIGS. 5 and 6, the apparatus 9 including the explosive tube 17 containing the explosive charge 15 as well as the dual projectile members 11 contained within the projectile tubes 14 are suspended from the main wire line 43. The tool 9 is lowered by the main wire line 43 into the well bore B, FIG. 6A, to a position beyond the lower end of the casing within the open hole or cavern H where the diameter is equal to or greater than the length of the explosive tube 17 combined with the projectile tubes 14. Based on *Newton's Theory of Penetration of Projectiles* into a Medium, the depth of penetration of a projectile is directly proportional to its length. The density of the projectile's material and the density of the medium the projectile passes through are actual variables. For example, a 1" square steel bar projectile which is 12" long and weighs approximately 3.4 lbs. has a density of 0.28333 lbs. per cubic inch, which converted is 7.843 grams per $cm^2$ of steel. Assuming the density of coal is 0.322 grams per $cm^2$, 7.8 grams per $cm^2$ divided by 0.32232 per grams per $cm_2$ equals 24.3319 as the multiplier. The depth of penetration of a 16" long steel projectile multiplied by 24 equals 32'. In this medium, coal, a 16' long steel projectile with a density of 7.842 grams per $cm_2$ would be expected to travel about 32 feet. According to *Newton's Theory*, the length of penetration does not depend on the initial velocity of the projectile, provided that the velocity is sufficiently high.

Figure 6B:
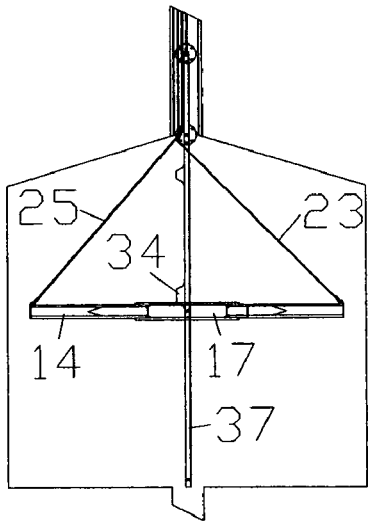
Figure 6C:
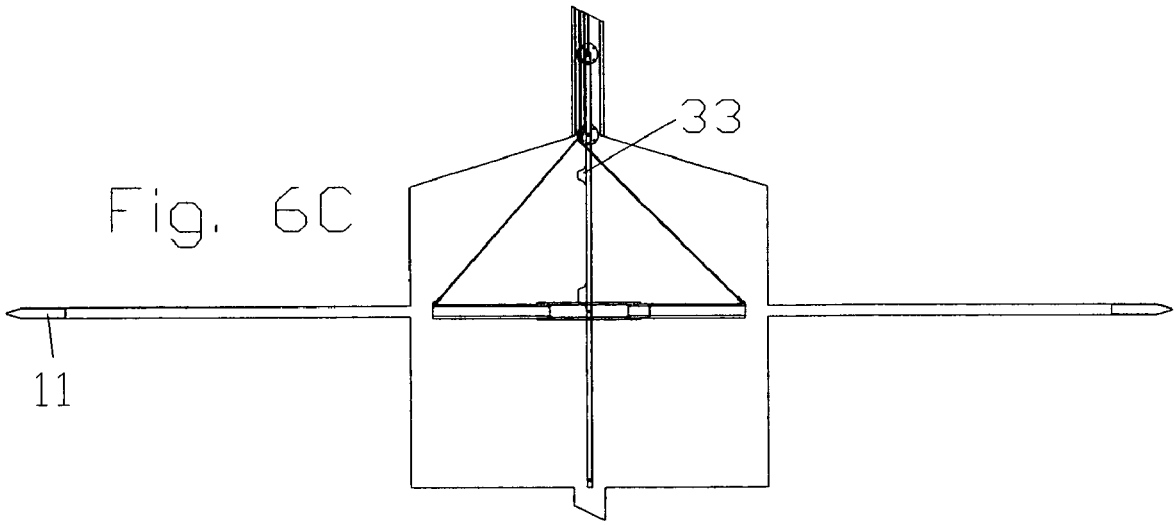

Once the apparatus 9 is lowered through the well bore B and into the open hole H, the explosive tube 17 and the projectile tubes 14 are then rotated to a desired firing angle, generally a position substantially perpendicular to the well bore as shown in FIG. 6B. The lower tube stop 34 allows rotation of the apparatus 9 to a position substantially perpendicular to the carrier plates and prevents the apparatus 9 from extending beyond perpendicular to the plates 37. The rotation is caused by pulling on the second rotator wire line 25 connected to the end of the projectile tube 14. The igniter wire 21 is either contiguous to or is embedded in the first rotator wire 23. The igniter wire 21 is then charged at the surface, the charge traveling down the igniter wire 21 to the igniter 19 which causes the explosive charge 15 to ignite. The explosive discharge causes the shear pins 45 to shear off resulting in a rapid expulsion of the projectile members 11. The projectiles 11 exit the projectile tubes 14 and proceed at a distance as described earlier into the open hole or formation. This is demonstrated in FIG. 5 and FIG. 6C.

The first rotator wire line 23 which is connected to the projectile tube 14 is then pulled to rotate the apparatus 9 back to a position parallel to the carrier plates 27, FIG. 6A. The upper tube stop 33 prevents the apparatus 9 from extending past the carrier plates 37. The main wire line 43 is then pulled to retrieve the apparatus 9 and the carrier plates 27 from the open hole. If necessary, there may be an attachment to the lower portion of the carrier plates 27 consisting of a plug or guide (not shown) that will allow the carrier plates 27 to be directed into a "rathole", indicated in FIG. 1 as R, which may provide further stability to the carrier plates 27.

DETAILED DESCRIPTION OF ALTERNATE PREFERRED FORM OF INVENTION

Figure 7:
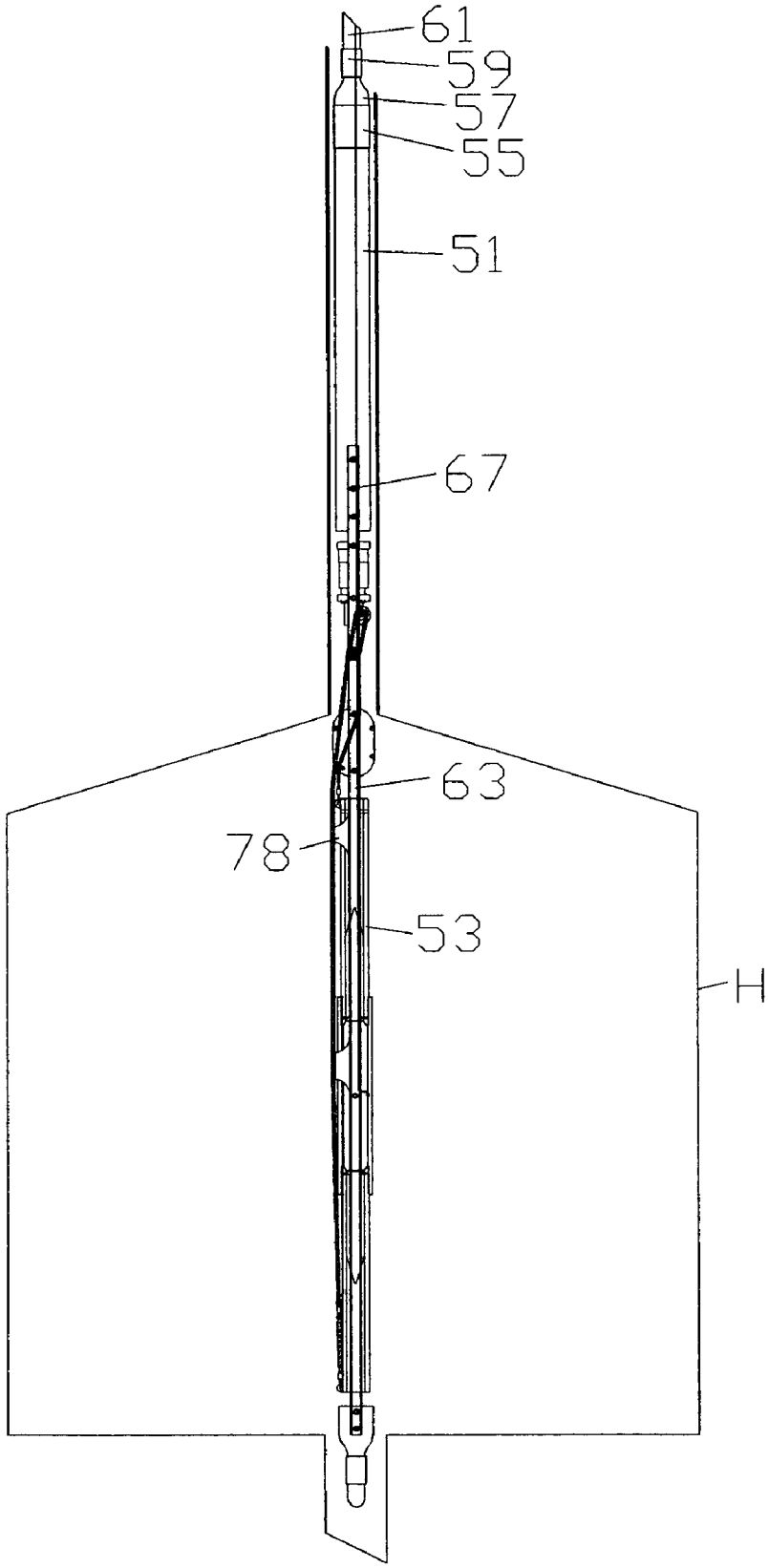
FIG. 7 is a side view in elevation of an alternate form of tool in accordance with the present invention.
Figure 8:
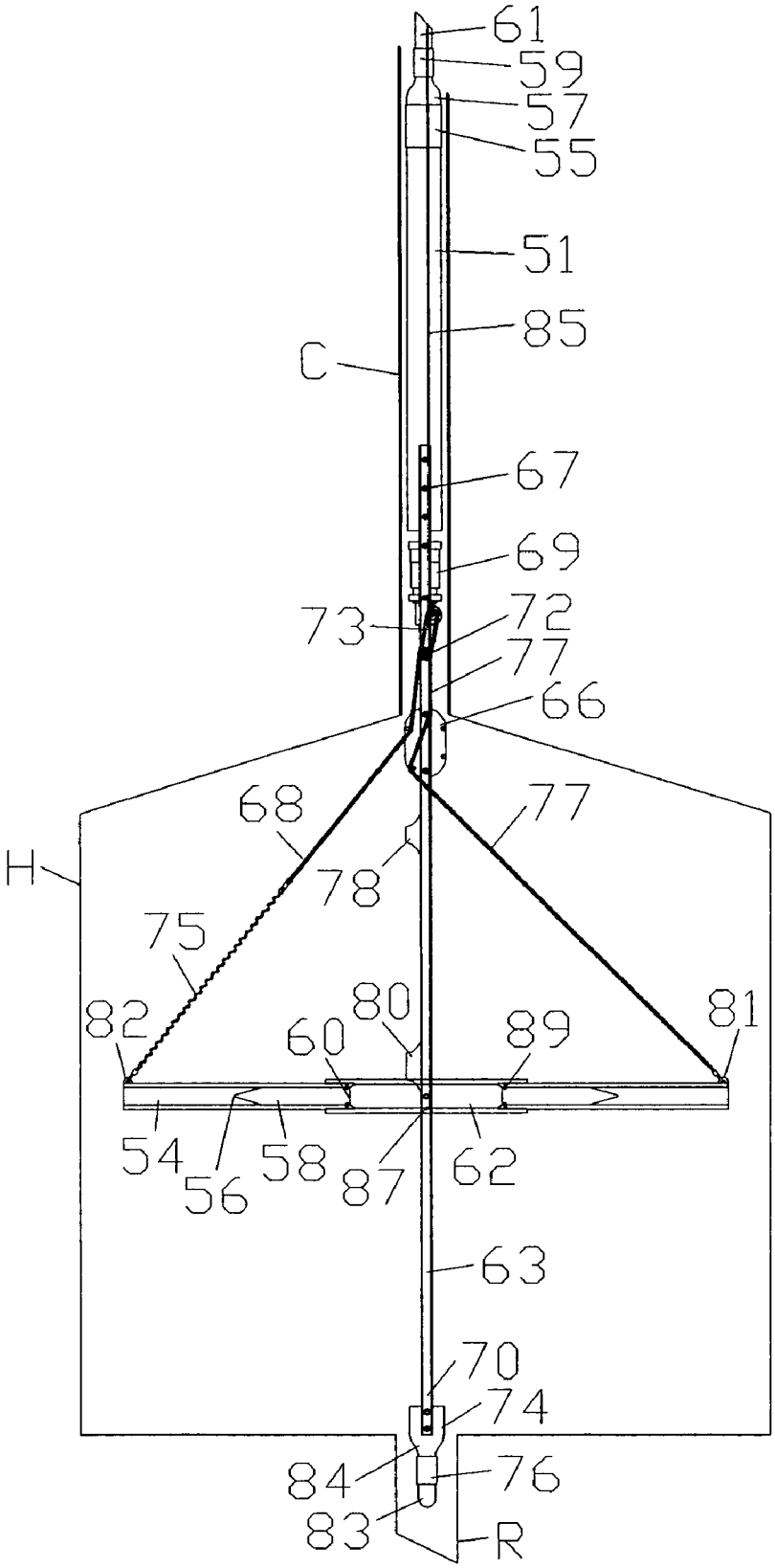
FIG. 8 is a side view in elevation of the form of invention shown in FIG. 7 with the tool being deployed into its firing position.
Figure 9:
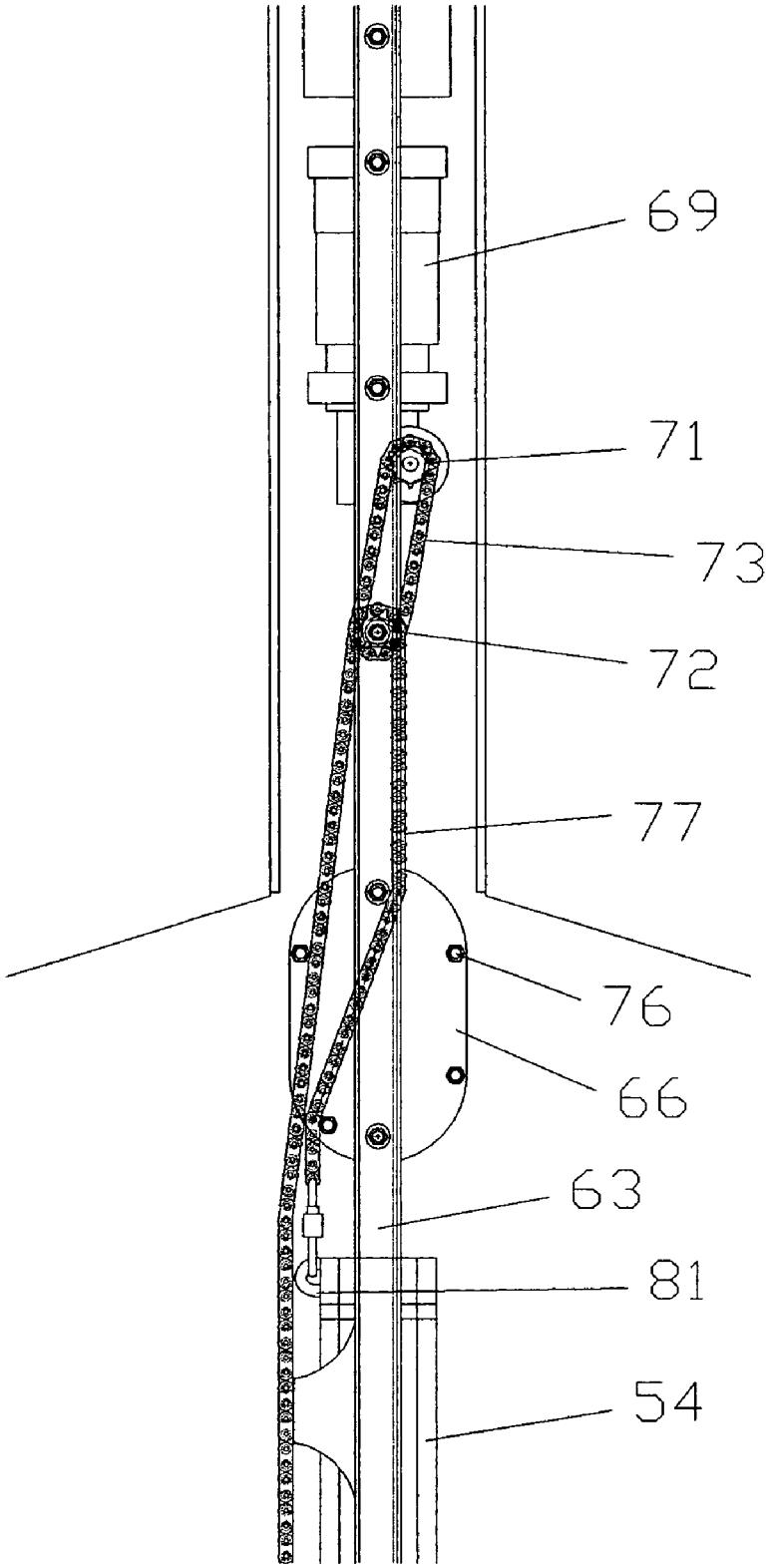
FIG. 9 is an enlarged side view of the tool shown in FIGS. 7 and 8.

FIGS. 7 to 12 demonstrate an alternate preferred embodiment of the present invention wherein large tubing 51, which is preferably rigid, conveys a projectile apparatus or tool 53 through the well bore and into the open hole H for delivery and removal. The tubing assembly, as shown in FIGS. 7 and 8, consists of the large tubing 51, an upper portion of which is connected to a nipple 55. The nipple 55 is then connected to a narrowing swage 57 which in turn is connected to a second nipple 59 which is then connected to small tubing 61. A lower end of the large tubing 51 is connected to complementary carrier plates 63 through bolts 67. A gear motor 69 as shown in FIG. 9 is also attached to the carrier plates 63 for rotation of the apparatus 53 within the open hole. A drive gear chain 73 is rotated around upper gear 71 and lower double gear 72 and driven by the gear motor 69. A separate rotator gear chain 77 encircles the lower double gear 72 which consists of two gears. One end of the rotator gear chain 77 is woven through gear bolts 76 located on interior plates 66, extending to attach to end bolt 81 which is attached to projectile tube 54. Referring to FIG. 8, the apparatus 53 has a pair of elongated projectile members 58 which are in the form of a bullet having a pointed end 56 and an opposite, squared rear end 60, the body being preferably formed of a high density metal, such as, steel. The projectile members 58 are releasably fixed within a pair of projectile tubes 54 by shear pins 89 which attach the projectile members 58 to the projectile tubes 54, in the same manner as described in the first preferred embodiment. The projectile tubes 54 are threadedly connected to an explosive tube 62 containing explosive charge 64, in the same manner as set forth previously in the first preferred embodiment. An opposite end 68 of the rotator gear chain 77 is also woven through the interior plate 66 and connected to a slack spring 75 which in turn is bolted through end bolt 82 to the projectile tube 54. An upper tube stop 78 is connected to the carrier plates 63, allowing the apparatus 53 to move back to aposition parallel to the carrier plates 63 but not beyond, for extraction from the well bore. A lower tube stop 80 acts in the same manner to allow rotation of the apparatus 53 while in the open hole to a position substantially perpendicular to the carrier plates 63, but not beyond. See FIG. 8.

The carrier plates 63 may possess an extension 74 at a distal end 70 for placement in a "rathole" R in order to stabilize the apparatus 53 during rotation. The extension 74 has a swage 84 which narrows the diameter so that a nipple 76 may be placed on an end of the swage 84. A centralizing bull plug nose 83 is placed on the end of the nipple 76 which is then set into the rathole R providing stability. The bull plug nose 83 is rounded to enable easy placement within the rathole.

Figure 10:
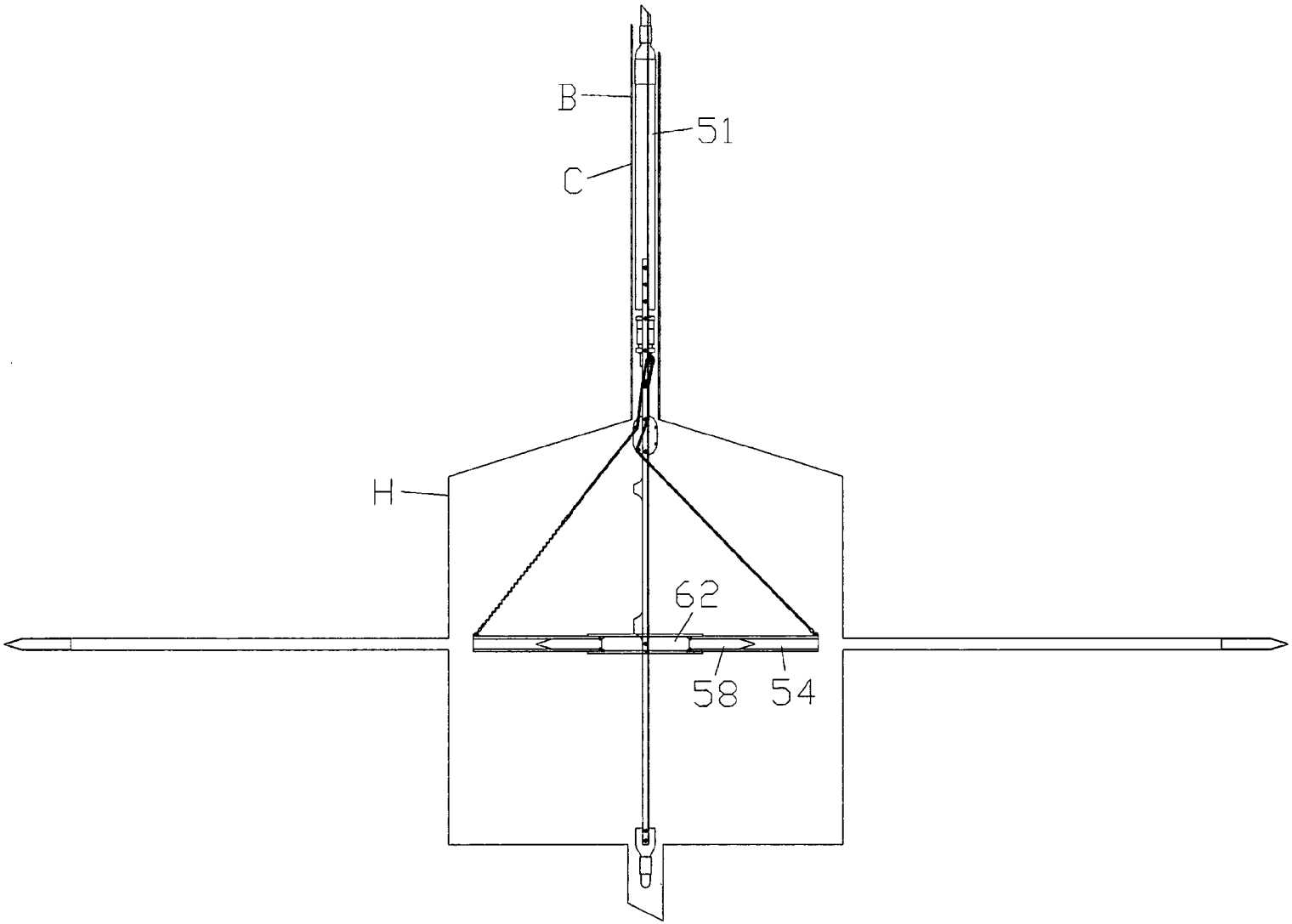
FIG. 10 is a somewhat schematic side view of the form of invention shown in FIG. 7 in its firing position.
Figure 11C:
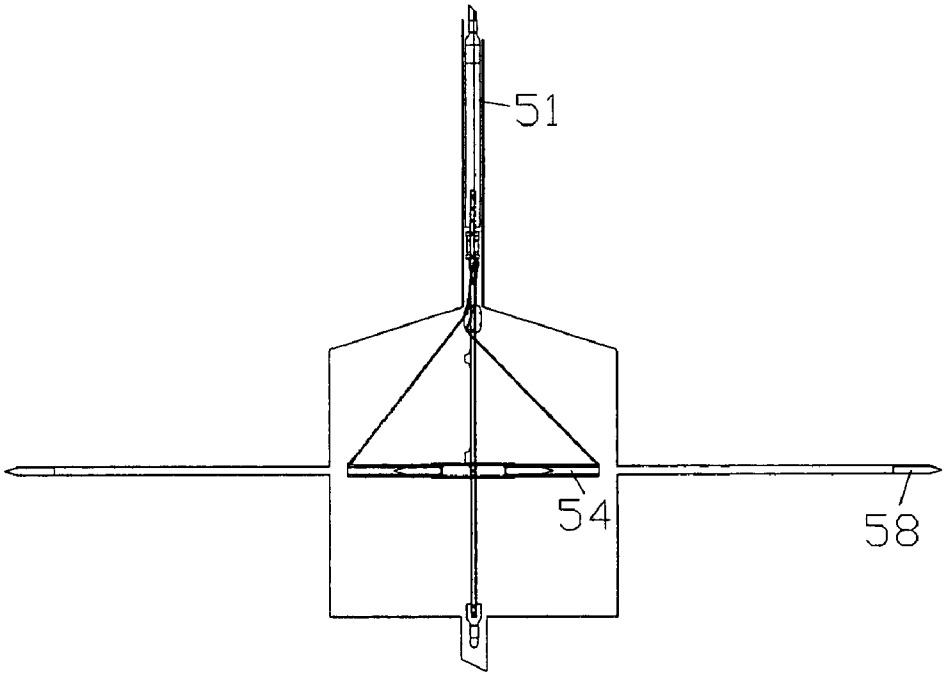
FIG. 11 is a schematic side view of the form of invention shown in FIG. 7 in its suspended, deployed and firing position.
Figure 11B:
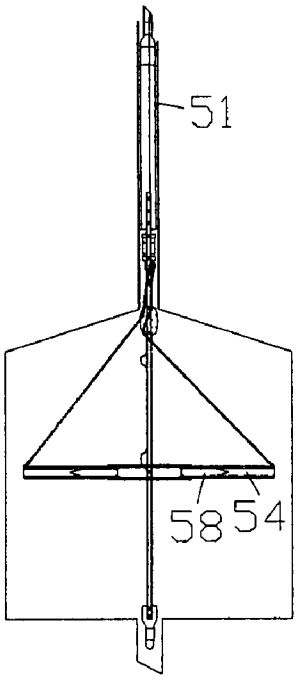
Figure 11A:
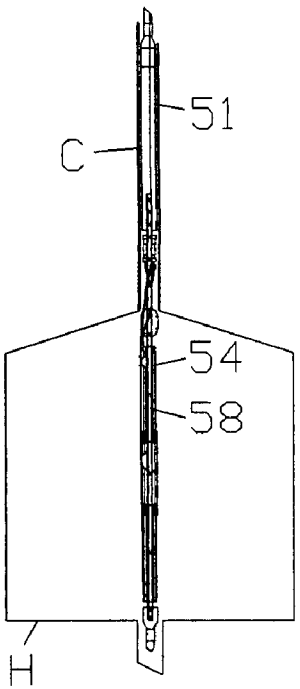
Figure 12B:
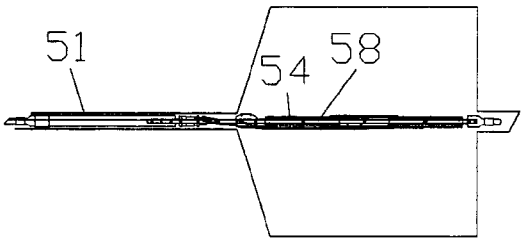
FIG. 12 is another schematic side view of the form of invention shown in FIG. 7 in its suspended, deployed and firing position utilizing directional drilling.
Figure 12C:
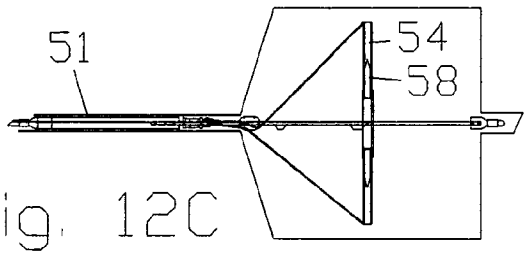
Figure 12D:
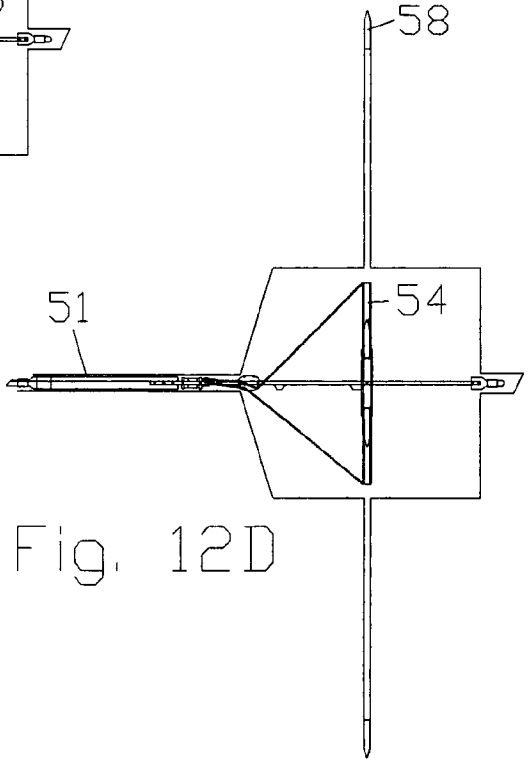
Figure 12A:
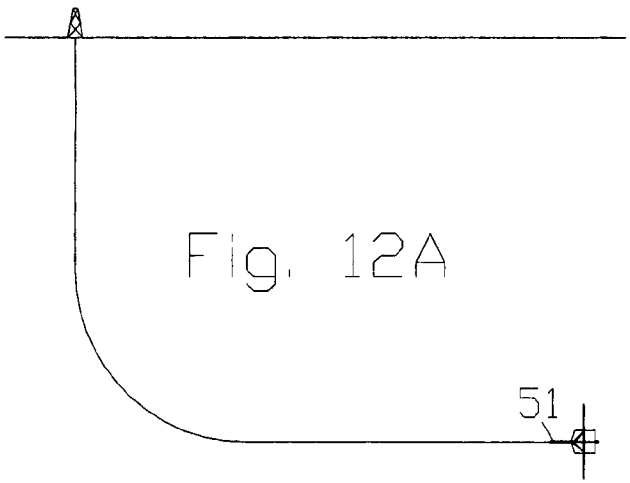

In the method as shown in FIGS. 10, 11 and 12, the apparatus 53 including the explosive tube 62 as well as the dual projectile members 58 contained within the dual projectile tubes 54 are suspended from the large tubing 51 which acts as a means of conveyance and suspension for the apparatus 53 in lowering the apparatus 53 downwardly through the casing C into the enlarged cavity or open hole H below the casing and which forms a continuation of the well B. The apparatus 53 is lowered in a position parallel to the complementary carrier plates 63 which is bolted to the large tubing 51. See FIG. 11A. The large tubing 51 may have sections of tubing added on to lengthen the mode of conveyance of the projectile apparatus 53 into the open hole. This also enables a user to advance the apparatus 53 in a vertical direction as well as in a horizontal direction as shown in FIG. 12A.

Once the apparatus 53 is lowered into the open hole, the carrier plates 63 with the bull plug 83 at the distal end is positioned within a rathole R to provide further stability. The projectile apparatus 53 is then rotated to a desired firing angle, which is accomplished through activation of the gear motor 60 which in turn causes rotation of the drive gear chain 73 around the gears 71 and 72. This rotation then causes rotation of the gear 72 resulting in a lengthening of the rotator gear chain 77 and a slackening of the spring 75 and shortening of the opposite chain end 68. See FIG. 11B. An igniter wire 85 is charged at the surface, the charge traveling down through the igniter wire 85 which passes through the large tubing 51, is interwoven with the rotator gear chain 77, passes along a side of the projectile tube 54 and connected to an igniter located at the center of the explosive tube 62. Once the charge travels down the igniter wire 85 to the igniter 87, this causes the explosive charge 64 to ignite. The explosive discharge causes the shear pins 89 to shear off in the rapid expulsion of the projectile members 58. The projectiles 58 exit the projectile tubes 54 and proceed at a distance as described earlier into the formation. See FIG. 10, FIG. 11C and FIG. 12D.

Following discharge of the projectile members 58, the explosive tube 62 which remains threadedly connected to the projectile tubes 54 is then oriented so that it is parallel to the carrier plates 63 as shown in FIG. 7. This is clone through rotation of the drive gear chain 73 which in turn causes rotation of the gear 72 causing a lengthening in the opposite gear chain 68 resulting in a shortening of the rotator gear chain 77, thereby pulling the projectile tube 54 into parallel position with the carrier plate 63. The upper tube stop 78 prevents the apparatus 53 from extending past the carrier plates 63. The large tubing 51 is then pulled to retrieve the apparatus 53 and the carrier plates 63 from the open hole and the well bore.

The preferred embodiment and alternate embodiments describe a dual projectile in which the projectiles are mounted in end-to-end relation and the explosive charge interposed between them so as to absorb any recoil. In the alternative, a single projectile may be utilized with an attached explosive charge at one end having a plug or stop at an opposite end so that once the explosion is detonated, the projectile member receives the full load of explosive and travels in a single direction.

It is therefore to be understood that while preferred forms of invention are herein set forth and described, the above and other modifications may be made therein without departing from the spirit and scope of the invention as defined by the appended claims and reasonable equivalents thereof.

I claim:

1. Apparatus for penetrating a cavern at a lower end of a well bore in a subsurface formation wherein the diameter of the cavern is greater than that of the well bore, said apparatus comprising:

means for penetrating said cavern, said means including an elongated projectile assembly having a projectile member disposed in said assembly and an explosive charge behind said projectile member, said projectile assembly being of a length greater than the diameter of said well bore but less than the diameter of said cavern;

a suspension member including means for advancing said suspension member through said well bore, said projectile assembly pivotally mounted externally of said suspension member for extension alongside said suspension member;

means for pivoting said projectile assembly between a first position extending substantially parallel to a longitudinal axis of the well bore and a second position substantially perpendicular to the longitudinal axis of the well bore; and means for detonating said explosive charge whereby to discharge said projectile member into a wall of said cavern.

2. Apparatus according to claim 1 wherein said projectile member includes an elongated metal rod.

3. Apparatus according to claim 1 wherein a pair of said projectile members are in end-to-end relation and said explosive charge therebetween.

4. Apparatus according to claim 1 wherein said detonating means includes an ignition member and an igniter wire running from said explosive charge to a surface above said well bore.

5. Apparatus according to claim 4 wherein said explosive charge and said ignition member are sealed off in watertight compartments.

6. Apparatus according to claim 1 wherein said pivoting means includes wire members secured to said suspension member and said projectile assembly.

7. Apparatus according to claim 1 wherein said suspension member has stop means whereby to direct the positioning of said projectile assembly within said cavern.

8. Apparatus according to claim 1 wherein said projectile member is disposed in a first tube, and said explosive charge is contained within a second tube and is threadedly connected to said first tube.

9. Apparatus for penetrating a subterranean formation surrounding an open hole which is located at a lower end of a well bore, said well bore having a diameter that is lesser than the diameter of said open hole, comprising:

at least one elongated projectile member;

an explosive charge disposed behind said projectile member, said projectile member and said explosive charge each disposed within a tube which are threadedly connected to one another forming a tubular housing;

said tubular housing having a length that is slightly less than the diameter of said open hole but greater than the diameter of said well bore;

means for advancing said tubular housing through said well bore, said advancing means including a suspension member and said tubular housing pivotally mounted on said suspension member;

means for orienting said tubular housing between a first position extending substantially parallel to a longitudinal axis of said well bore and a second position substantially perpendicular to the longitudinal axis of said well bore;

means for detonating said explosive charge; and means for discharging each of said projectile members into the formation surrounding said open hole.

10. Apparatus according to claim 9 wherein said detonating means includes an igniter wire running to a well surface.

11. Apparatus according to claim 9 wherein a pair of said projectile members are mounted in end-to-end relation to one another, and said explosive charge is mounted between adjacent ends of said pair of said projectile members.

12. Apparatus according to claim 9 wherein said tubular housing is mounted on an external surface of said suspension member.

13. Apparatus according to claim 9 wherein said orienting means includes wire members secured to said suspension member and said tubular housing.

* * * * *

UNITED STATES PATENT AND TRADEMARK OFFICE

CERTIFICATE OF CORRECTION

PATENT NO. : 6,978,848 B2
DATED : December 27, 2005
INVENTOR(S) : Nackerud, Alan L.

It is certified that error appears in the above-identified patent and that said Letters Patent is hereby corrected as shown below:

Column 2,
Line 5, cancel "lenath" and substitute -- length --.

Column 4,
Lines 53 and 57, cancel "$cm_2$" and substitute -- $cm^2$ --.
Line 56, cancel "16"" and substitute -- 16" --.

Column 5,
Line 65, cancel "aposition" and substitute -- a position --.

Column 6,
Line 53, cancel "clone" and substitute -- done --.

Signed and Sealed this

Twenty-first Day of March, 2006

JON W. DUDAS
*Director of the United States Patent and Trademark Office*